United States Patent [19]

Hanson et al.

[11] Patent Number: 4,889,186

[45] Date of Patent: Dec. 26, 1989

[54] OVERLAPPING HORIZONTAL FRACTURE FORMATION AND FLOODING PROCESS

[75] Inventors: Merle E. Hanson, Livermore; Lewis D. Thorson, Milpitas, both of Calif.

[73] Assignee: Comdisco Resources, Inc., San Francisco, Calif.

[21] Appl. No.: 186,046

[22] Filed: Apr. 25, 1988

[51] Int. Cl.[4] ..... E21B 43/26; E21B 43/30

[52] U.S. Cl. ..... 166/252; 166/271; 166/245; 166/308

[58] Field of Search ..... 166/308, 271, 259, 245, 166/250, 252

[56] References Cited

U.S. PATENT DOCUMENTS

| | | | |
|---|---|---|---|
| 2,862,556 | 12/1958 | Tek | 166/308 |
| 2,946,382 | 7/1960 | Tek et al. | 166/259 |
| 3,199,586 | 8/1965 | Henderson et al. | 166/271 X |
| 3,501,201 | 3/1970 | Closmann et al. | 166/271 X |
| 3,682,246 | 8/1972 | Closmann | 166/271 |
| 3,810,510 | 5/1974 | Fitch et al. | 166/271 |
| 4,005,750 | 2/1977 | Shuck | 166/308 |
| 4,044,828 | 8/1977 | Jones et al. | 166/308 X |
| 4,265,310 | 5/1981 | Britton et al. | 166/259 |
| 4,432,078 | 2/1984 | Silverman | 166/308 X |
| 4,529,036 | 7/1985 | Daneshy et al. | 166/308 X |
| 4,687,061 | 8/1987 | Uhri | 166/308 |
| 4,714,115 | 12/1987 | Uhri | 166/308 |

OTHER PUBLICATIONS

"The Street Ranch Pilot Test of Fracture-Assisted Steamflood Technology", SPE 10707, Britton et al, pp. 69–93, Mar. 26, 1982.

"Effects of Hydraulic Fracturing in Oklahoma Waterflood Wells", John P. Powell, Kenneth H. Johnston; Dept. of Interior Oklahoma; Report of Investigations 5713.

"The Application of Hydraulic Fracturing in the Recovery of Oil by Waterflooding: A Summary"; James A. Wasson; Dept. of Interior; Information Circular 8175.

"Gravity Drainage of Oil into Large Horizontal Fractures"; Morrisson et al; Gulf Research & Development Co, Pittsburgh, Pa., vol. 219, 1960, pp. 7–15.

"Optimizing Program Increases Field's Profit's"; Technology; Tom Huebinger et al; Aug. 29, 1988, Oil & Gas Journal, pp. 35–39.

"A Comprehensive Fracture Diagnostics Experiment: Part 1—An Overview"; Fitz-Patrick et al; SPE Production Engineering, Nov. 1986, pp. 411–431.

(List continued on next page.)

*Primary Examiner*—Stephen J. Novosad

*Attorney, Agent, or Firm*—Christie, Parker & Hale

[57] ABSTRACT

A process for enhanced recovery of hydrocarbons, such as oil from a geological reservoir through an injection well bore and a plurality of production well bores which extend into the geological reservoir. Flooding is performed through at least one injection well bore into a lower portion of the geological reservoir, to thereby form a substantially horizontal injection fracture which may have an upward vertical component. The vertical component is elongated along an azimuth. The vertical components of any significance size are not always formed on horizontal fractures. However, to avoid intersecting horizontal production fractures into the vertical components, certain procedures must be followed. To this end, the azimuth of the elongation of the vertical component is determined. The producing well bores are then disposed, substantially parallel with the azimuth of the elongation of the vertical component and along a line displaced from the injection well bore. Substantially horizontal production fractures are formed through the production well bores out into overlapping relation with and displaced above the injection fracture, without intersecting the vertical component. This arrangement allows for a vertical sweep, using a waterflood, through the geological reservoir between the overlapping portions of the injection fracture and the production fractures to sweep out the hydrocarbons.

36 Claims, 3 Drawing Sheets

OTHER PUBLICATIONS

"Fracture Optimization in a Tight Gas Play: Muddy J Formation, Wattenberg Field, Colorado", C. N. Roberts, Amoco Production, Co. SPE/DOE 9851; pp. 245–252, May 29, 1981.

"Effect of Fracture Azimuth on Production with Application to the Wattenberg Gas Field"; SPE 8298; Smith, Member SPE–AIME, Amoco Production Co., Sep. 26, 1979.

"The Azimuth of Deep, Penetrating Fractures in the Wattenberg Field"; Smith et al; Feb. 1978; Journal of Petroleum Technology, pp. 185–193.

"Fracture Azimuth—A Shallow Experiment"; Smith et al; Jun. 1980, vol. 102; Journal of Energy Resources Technology, pp. 99–105.

'Physical Principles of Oil Production'; Morris Muskat, PhD., International Human Resources Development Corporation, Chapter 12, pp. 645–682, pub. 1981.

OVERLAPPING HORIZONTAL FRACTURE FORMATION AND FLOODING PROCESS

BACKGROUND OF THE INVENTION

1. Field of the Invention

This invention relates to method and apparatus for the production of hydrocarbons from geologic oil-bearing formations, and more particular, method and apparatus for enhancing the secondary recovery of oil from such formations.

2. Brief Description of the Prior Art

Oil has been recovered from geological oil bearing reservoirs through wells in a variety of ways. Where the reservoir contains sufficient pressure the oil may be forced out of the reservoir through a well without assistance. Pumps are also used to lift oil out of a well.

Many times a reservoir does not contain sufficient pressure to force the oil out of the reservoir into the well and secondary recovery techniques are required for recovery. One method widely used is to flood the reservoir from one or more injection wells to drive the oil from the reservoir to adjacent production wells from which the oil is lifted to the surface.

Flooding has been performed with a variety of fluid medium, including surfactants, water at normal temperatures, water at elevated temperatures and steam. Specially prepared fluids have been used to cause the oil to more easily move out of the formation.

Fracturing is a well known technique for enhancing the flow of fluid from injection wells and the flow of fluid from the reservoir into the production wells. Specifically, fluid has been forced through the opening in an injection well into the surrounding geological formation to fracture or open up the surrounding sands. Propping materials, such as sand particles, have been injected into the induced injection fracture to hold the fracture open and allow the fluids to flow more readily to the formation from the injection well. Similarly, fluids have been forced through the openings in a production well into the surrounding formation to fracture or open up the sands. Propping materials, such as sand particles, have been injected into the sands of the induced production fractures to hold the formation open to thereby allow the oil and other fluid in the surrounding formation to flow more easily into the production well.

U.S. Pat. No. 2,862,556 to Tek et al. discloses an example of such water flooding methods using an injection well and production well surrounded by fractures. The horizontal fracture is induced through and around the injection well at one level, preferably at a lower level or adjacent the bottom of the formation, whereas horizontal fractures are induced around the production wells at a higher level or adjacent the top of the formation. Production fractures overlap with the injection fracture. A water drive is applied through the lower injection fractures to the upper production fractures so as to lift the oil to the upper fracture. Tek points out that the direction of the drive may be reversed. Another U.S. Pat. No. 2,946,382 to Tek et al discloses flooding between horizontal overlapping injection and production fractures, using such media as hot combustible gas, hot water, super heated steam and other hot fluids.

U.S. Pat. No. 3,199,586 to Henderson et al discloses a method for increasing the amount of oil recovered in a water flood, between horizontally extending fractures of the type disclosed in the Tek patents. Specifically, Henderson discloses the use of water containing a surfactant to help flood the oil from the surrounding formation and allow it to flow more easily into the production well. Also disclosed is a method for creating a line of injection wells and a line of injection fractures, one in communication with each injection well. Spaced away in a somewhat parallel pattern is a line of production wells and a line of production fractures, one in communication with each production well. Fluid injected into the injection wells flows out into the vertically extending injection fractures, then across the formation into the vertical production fractures. No discussion or suggestion is made in Henderson that the two arrangements may be somehow combined.

U.S. Pat. No. 4,265,310 to Britton discloses a fracture preheat oil recovery process.

An article entitled *Gravity Drainage of Oil Into Large Horizontal Fractures*, by T.E. Morrisson, James H. Henderson, published in Trans of AIME VOL., 219, pages 2–15 (1960), discusses the production of oil through horizontal extending fractures of high capacity and large radius placed at the base of producing formations. Gravity drains the fluid into the producer fracture, and hence into the production well from which the fluid is lifted to the surface. This technique is satisfactory where the oil is of low viscosity for ease of flow, but has drawbacks where the oil has higher viscosities and the producing formation is then thin. Additionally, the recovery rate is slow since fluid flow depends principally on the flow of gravity.

Other articles have been written relating to hydraulic fracturing for the recovery of oil. For example, note the article entitled *Application of Hydraulic Fracturing in the Recovery of Oil by Water Flooding: A Summary*, by James Wasson, published by the Bureau of Mines Information Circular, 8175 (1963), the article *Effects of Fractures Hydraulic in Oklahoma Water Flood Wells*, by John P. Powell & Kenneth H. Johnson, published by the Bureau of Mines Information Circular, 5713 (1960), and the article *The Street Ranch Pilot Test of Fracture-Assisted Steam Flood Technology*, by Britton, Martin, Lebricht and Harmon, presented at the 1982 meeting of the SPE.

The Tek and Henderson methods disclosed above using horizontal overlapping production and injection fractures at, respectfully, the top and bottom of the well, apparently have not been commercially successful.

SUMMARY OF THE INVENTION

The present invention is directed to overlapping horizontal fracture formation and flooding, which significantly enhances the reliability of achieving successful producing oil wells, using secondary recovery techniques. The invention also enhances the oil volume recovery from geological formations, with substantially enhanced reliability.

Briefly, an embodiment of the present invention is a process for enhanced recovery of hydrocarbons, such as oil, from a geological reservoir through an injection well bore and plurality of production well bores, which extend into the geological reservoir. The process involves fluid flooding through at least one injection well bore into a lower portion of the geological reservoir, to thereby form a substantially horizontal injection fracture which may have an upward vertical component. The vertical component is elongated along an azimuth. Vertical components of any significant size are not always formed on horizontal fractures. However, to avoid intersecting horizontal production fractures into a vertical component the azimuth of the elongation of the vertical component is determined. The producing well bores are then disposed, substantially parallel with the azimuth of the elongation of the vertical component and along a line displaced from the injection well bore. Substantially, horizontal production fractures are formed through the production well bores out into overlapping relation with and displaced above the injection fracture, without intersecting the vertical component. This arrangement allows for a vertical sweep, using a fluid flood, through the geological reservoir between the overlapping portions of the injector fracture and the production fractures to sweep out the hydrocarbons.

By determining the azimuth of the elongation of the vertical component, the production wells can thus be formed and limited in size during formation so as not to intersect and provide an undesirable direct path for the fluid flood from the injection fracture to the production fractures.

Preferably, the process includes formation of a plurality of injection wells and a horizontal injection fracture for each injection well. Each injection fracture extends horizontally from the injection well bore, approximate the lower surface of the hydrocarbon reservoir. Preferably, the horizontal extent of the injection and production fractures maximize the overlap in the reservoir zone therebetween.

DETAILED DESCRIPTION

Figure 4:
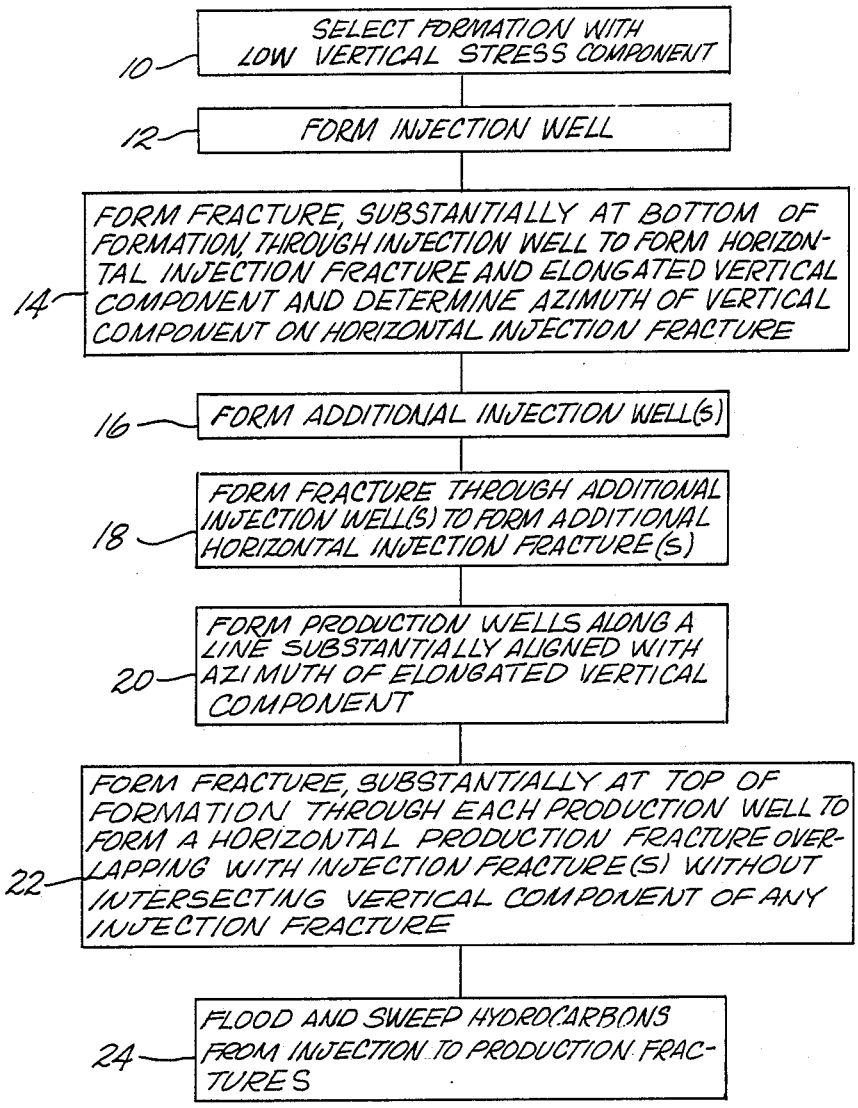
FIG. 4 is a flow diagram depicting the process for forming the horizontal overlapping fractures for fluid flooding and embodies the present invention.

Refer now to the figures and the disclosed waterflood process embodying the present invention. Blocks 10–24 of FIG. 4 depict a sequence of steps of the process, according to the present invention. Initially, a geological formation 28 is selected having a shallow geological hydrocarbon, preferably oil, bearing reservoir 29 that has a ratio of vertical to horizontal stress components of less than 1 (Block 10). The reservoir discussed below should also have at least 10 vertical feet and preferably 15 up to about 50 vertical feet or more between bottom *29a* and top *29b* extremities of the reservoir, without continuous low permeable sheets that would block or impair the flow of fluid flood through the reservoir between horizontal injection and production fractures. The porosity and oil saturation of the formation will determine the acceptable thickness. The greater the porosity and/or the greater the oil saturation, the smaller the acceptable thickness of the reservoir.

Shallow reservoirs, defined herein as those having ratios of vertical to horizontal stress components of less than 1, are typically those located in shallow geological formations and permit the formation of horizontal fractures, as opposed to vertical fractures. Shallow reservoirs are typically at depths of more than about 100 feet and less than about 1200 feet below the surface of the earth. The lower surface of a shallow reservoir may be lower or higher under certain tectonic conditions.

An injection well 30 is then formed, from the surface of the earth through the shallow reservoir 23 by drilling a well bore and casing the well bore with casing 36 clear through the oil bearing reservoir (Block 12). Subsequently, a fracture fluid 32 is applied under high pressure, substantially at the lower surface or bottom *29a* of the reservoir 29, through an opening 34 that extends transversely through casing 36 in injection well 30. Preferably, where the well spacing is 2½ acres per well, 60,000 to 70,000 gallons of fracture fluid are injected, thereby forming a large horizontal injection fracture 38 at the lower portion, preferably substantially at the bottom *29a* of the reservoir 29. A horizontal fracture is one which is induced by injecting a fluid, such as water, through a well and which propagates in a substantially horizontal direction from the well, covering a large horizontal surface area as compared to its vertical cross-sectional area. When forming the horizontal injection fracture, a horizontally elongated vertical component 40 may be formed upward from the top of the horizontal injection fracture because of the stress conditions in the reservoir and the fracture treatment parameters and the way the fracture fluid is applied. The horizontal and vertical fractures are each a very thin crack having an opening between two opposite faces. The size of the opening between the large opposite faces of the horizontal fracture is in the range of 0.05 inches and 0.2 inches and the size of the opening between the large opposite faces of the vertical component is generally smaller. One reason that the opening is so small for both is because the sands of the reservoir are consolidated and exhibit competent rock characteristics.

Figure 1:
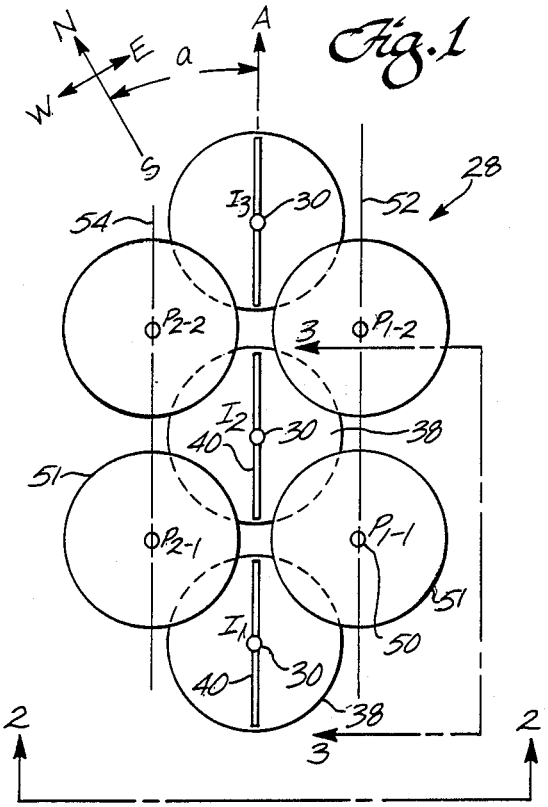
FIG. 1 is an aerial schematic representation of overlapping horizontal fractures in a geological formation for use in water flooding and embodying the present invention.
Figure 2:
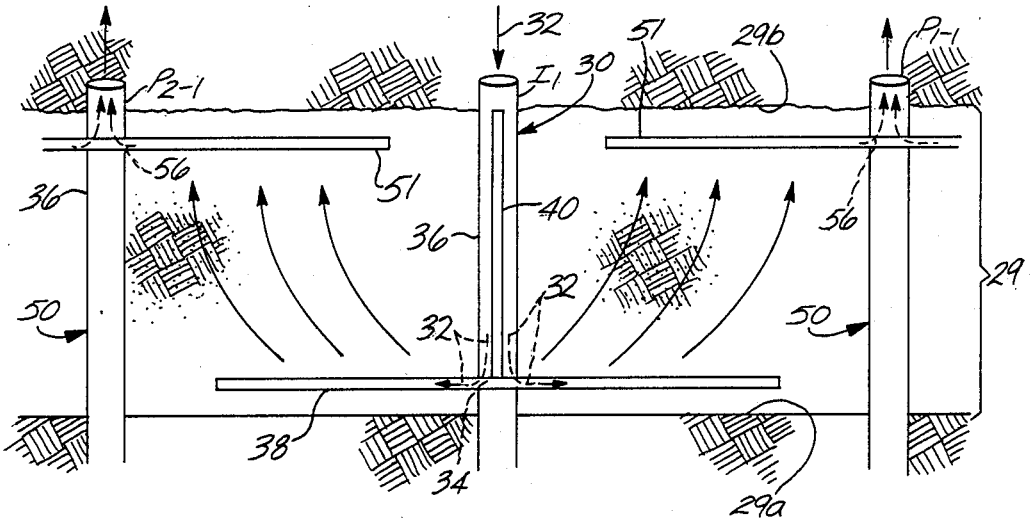
FIG. 2 is a cross-sectional view of the geological formation depicted in FIG. 1, along the Lines 2—2, depicting injection well I1, and the corresponding horizontal injection fracture and production wells P2-1 and P1-1 and corresponding horizontal production fractures.

The vertical component is aligned parallel with and extends out in opposite directions from the bore of well 30 and along azimuth line "A", as can be seen in FIGS. 1 and 2. The horizontal injection fracture is generally disc shaped and the vertical component may extend vertically from the top of the disc shape up to, in some cases, close to the top *29b* of the reservoir 29.

Methods and apparatus are well known, in the art, for forming such fractures, see for example, the discussion in the article entitled "Hydraulic Fracturing", SPE-AIME Monograph Vol. 2, Dallas, 1970, by Howard, G.C. and Fast, C.R. the disclosure of which is incorporated by reference herein. Briefly, the horizontal injection fracture is formed by applying fluid through the injection well bore, causing the formation to open or fracture. Propping materials are slurried or mixed into the fracture fluid being passed into the fracture under pressure. As a result the propping material enters the fracture. After fluid pressure is removed, the propping material props open the fracture to the extent of the distance to which the proppend has been carried. The propped horizontal fracture allows fluid pressure, applied in the well during the fluid flood, to extend out horizontally substantially over the propped portion of the horizontal fracture and, therefore, the pressure to be applied over of the propped portion of the horizontal surface area of the fracture.

The opening 34 is preferably formed by cutting a ring through the casing 36 leaving preferably about a 2 inch ring shaped gap in the casing. One may also create entries through holes or slots in the casing. This technique is sometimes called notching. One process for forming the opening is a jetting process such as that disclosed is JPT May 1961, p. 489, JPT May 1961, p. 483 and SPE June 1963 p. 101, the disclosure of which is incorporated herein by reference.

Preferred results have been obtained from fracturing by using between 80,000 and 90,000 pounds of sand in the fracture fluid as a propping material in a 2½ acre per well spacing. Substantially enhanced results have been achieved using number 12/20 mesh sand as compared with smaller size sand. However, in general, the largest size sand as possible should be used that results in the highest conductivity in the fracture. If the well spacing is increased or decreased, the amount of sand and fracture fluid is, respectfully, increased or decreased.

The vertical component is caused along the horizontal azimuth because it is parallel to the maximum horizontal stress component of the reservoir formation. The location and azimuth "A" of the vertical component is quite important in forming and locating the production fractures, as will be explained.

Also, at Block 14, the azimuth of the vertical component 40 is determined. The preferred method for determining the azimuth of the vertical component on a horizontal fracture is to set an array of 8 to 12 biaxial tilt meters, each at a different location, on the surface of the earth in a circle around the well while the fracture is being formed to monitor the tilt of the surface of the earth at each location. By monitoring and processing changes in the angles of the earth's surface tilt caused by the fracture using tilt meters, the azimuth or strike of the vertical component of the fracture may be accurately determined. Processes for use of tilt meters to determine the presence of a vertical component and its azimuth or strike is disclosed at pages 1 to 9 of *Analysis and Implications of Three Fracture Treatments in Coal at the USX Rock Creek Site Near Birmingham, Alabama*, Quarterly Report, July 1986 to October 1986, by the Gas Research Institute. The content of which is incorporated herein by reference.

A preferred shallow reservoir, that is selected, is one where there are substantially continuous, highly permeable sands, from top to bottom in the reservoir, from which the hydrocarbons can be extracted using a fluid flood. Various techniques exist for determining the top and bottom of the reservoir. By way of example, the geological formation can be cored, through the reservoir, during drilling the injection well. Preferably the drilling is extended clear through the reservoir while coring and subsequently the reservoir is logged. By analyzing the core samplings, and the logs, using techniques well known in the art, one can determine the transition to the highly permeable sands in the reservoir from the tight sands, where no movable oil exists. This transition occurs at the top **29*b* of the well. By monitoring the core samples and logs, one can also determine the transition from the highly permeable sands in the reservoir back to the tight sands, where no movable oil exists, below the bottom 29*a*** of the reservoir.

At Block 16 of FIG. 4, additional injection wells 30 are formed, preferably along the azimuth "A" of the vertical component 40 of the first horizontal injection fracture. The first well is indicated by the symbol I1, whereas additional wells are indicated, by way of example, by the symbols I2 and I3. Each injection well is substantially the same as and is formed in substantially the same way as well I1.

At Block 18, additional large horizontal injection fractures 38 are formed through each of injection wells I2 and I3, substantially the same as and in substantially the same way as for well I1. The additional fractures are large substantially horizontal fractures and each may have a vertical component 40, extending in the direction of the azimuth "A". If desired, the azimuth "A" of the elongated vertical component can be determined for each horizontal fracture using tilt meter techniques discussed above. However, this is not normally necessary, as the azimuth can be predicted from the azimuth of the vertical component of the first horizontal fracture in the reservoir. Prediction of the azimuth of the vertical component, for each subsequent fracture, can be predicted without use of additional tilt meter tests, if the geological formation is known to be tectonically similar and the azimuth of the vertical component of a previously formed horizontal fracture has been determined.

Production wells 50 are each formed, by drilling a bore hole and putting a casing 36 in the bore hole, extending from the surface of the earth through the reservoir 29. By way of example, four production wells 50 are indicated at P1-1, P1-2, P2-1 and P2-2. The wells P1-1 and P1-2 are aligned along a line 52, displaced from, but substantially parallel with the azimuth "A" of the elongated vertical component of each of the injection wells 30. Similarly, each of the production wells P2-1 and P2-2 are aligned along a line 54, which is displaced from, but substantially parallel with the azimuth "A".

At Block 22, a fracture is formed in reservoir 29, at the upper portion substantially at the top or upper surface **29*b* of the reservoir, through an opening 56 in the casing 58, of each of production wells 50. The horizontal production fracture formed around each production well, is a large substantially horizontal fracture which has a similar shape to and is formed in a similar manner to and using similar techniques to that discussed above for the horizontal injection fractures. Typically, the production fractures are made slightly smaller than the injection fractures by applying or inducing, preferably 35,000 to 38,000 gallons of fracture fluid and preferably 50,000 to 60,000 pounds of substantially the same size sand as used for the injector well. The production fractures extend horizontally out over and overlap adjacent horizontal injection fractures as illustrated in FIG. 1**.

Figure 3:
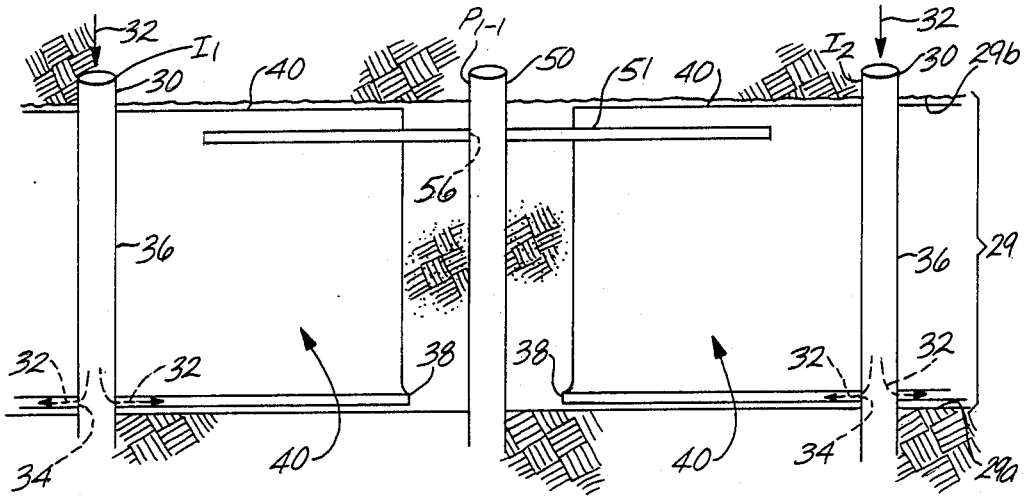
FIG. 3 is a cross-sectional view of the geological formation depicted in FIG. 1, along the Lines 3—3, depicting injection wells I1 and I2 with corresponding horizontal injection fractures and production well P1-1 with the corresponding horizontal production fracture, but removing production well P1-2 and its corresponding horizontal production fracture.

The vertical component of the horizontal injection fracture will extend from the horizontal injection fracture to the top **29*b* of the reservoir as illustrated in FIGS. 2 and 3** and, therefore, above a horizontal plane intersecting the production fracture. Therefore, the diameter of the horizontal fractures are limited in size and the production wells are aligned with the azimuth "A", to prevent the production fractures and vertical components from intersecting and short circuiting, and thereby preventing proper flow of fluid between injection and production fractures through the reservoir during water flooding.

The injection and production fractures are typically designed before they are formed. In the case of the production fractures, these fractures are designed ahead of time so that, as discussed above, they do not extend out far enough to intersect the azimuth of the vertical components of the horizontal injection fractures. Techniques for the design, including sizing of fractures, are well known in the art and need not be discussed in detail. However, one technique that may be employed for designing and sizing a production fracture so that it does not intersect the azimuth of the vertical component of the horizontal fracture is outlined by way of example. Specifically, one may determine the thickness or vertical dimension of the fracture by knowing the geological or rock properties in the reservoir and properties of the fracture fluid in which the horizontal production fracture is to be formed. Knowing the approximate thickness that will be formed in the production fracture and knowing that the fracture would be generally disk shaped, a maximum radius is assigned to the production fracture beyond which the fracture should not go so as to avoid intersecting the azimuth of the vertical components of the injection fractures. Knowing the maximum radius and the thickness, the maximum permissable volume of the fracture and the amount of fluid which leaks out into the surrounding formation maximum volume of the fracture fluid is then computed. The volume of the production fracture will be changed depending on various additional factors. For example, if the well is close to the proximity of a reservoir boundary, the size and therefore volume of the production fracture is reduced to avoid running into the boundary. If the production fracture runs into the boundary of the reservoir, it is possible that the fracture will grow away from the edge and may intersect another fracture. The sequence of steps and, therefore, the design of typical large production and injection fractures is as follows

LARGE PRODUCTION FRACTURE

Introduce as fracture fluid slurries the following in sequence:

12000 gal. of gelled water (pad)
2000 gal. of 1 ppg. 20/40 frac sand
2000 gal. of 1 ppg. 12/20 frac sand
5500 gal. of 2 ppg. 12/20 frac sand
14000 gal. 3 ppg. 12/20 frac sand
1200 gal. gelled water (flush)
(Total:
36700 gal. of gelled water
2000 lb. of 20/40 frac sand
55000 lb. of 12/20 frac sand)

LARGE INJECTION FRACTURE

Introduce as fracture fluid slurries the following in sequence:

23000 gal. of gelled water (pad)
3000 gal. of 1 ppg. 20/40 frac sand
2000 gal. of 1 ppg. 12/20 frac sand
5000 gal. of 2 ppg. 12/20 frac sand
22000 gal. of 3 ppg. 12/20 frac sand
1200 gal. gelled water (flush)
(Total:
56200 gal. of gelled water
3000 lb. of 20/40 frac sand
78000 lb. of 12/20 frac sand)

Where ppg is pounds of sand per gallon of gelled water and the gelled water is a mixture of water and a vegetable guar, mixed 40 pounds of guar per 1000 gallons of water. The guar is a well known vegetable substance used to thicken fluid.

It is possible to drive the vertical components a great distance with little fluid. The vertical growth of the vertical component has been successfully controlled in certain applications by adding a ¼ pound per gallon of 20/40 sand about half-way through the introduction of the gel pad.

Figure 5:
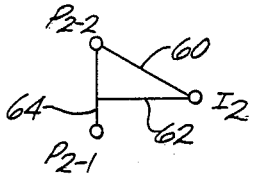
FIG. 5 is a schematic elevation view depicting the horizontal spacing between injection and production wells.

One application is depicted in FIG. 5 where the injection wells are spaced between production wells in a 2½ acre per well spacing and the preferred distance 60 from an injection well and the closest two production wells is about 330 feet. However, assuming the distance 62 between an injection well ad a line 64 between the closest production well is about 283 feet, preferably, the radius of the injection fractures are each about 265 to 285 feet and the radius of each of the production fractures are about 235 to 250 feet. Where the well spacing is smaller or greater, the dimensions are decreased or increased proportionally.

When all of the desired injection and production wells are in place and the corresponding horizontal and horizontal production fractures formed, production is commenced.

At Block 24, a flood is applied through the well bore of each injection well 30, out through the horizontal injection fractures. This pressurized fluid forms a pressure gradient between each horizontal injection fracture and the overlapping horizontal production fracture or fractures, causing the fluid to sweep the hydrocarbons upward from the horizontal injection fractures into the overlapping horizontal production fractures, and then into the well bores of the production well out through the production wells to surface equipment where the hydrocarbons and water are retrieved and separated. The fluids may contain surfactants and hot water or cold water, depending on the application.

Enhanced results have been achieved by pumping the fluid entering the production wells, keeping the level of fluid in the production wells pumped down to the top **29*b*** of the reservoir.

The casings of the injection and production wells are typically 5½ inches in diameter. In some cases, the production casings will have to be of a larger diameter to satisfy equipment requirements.

Accordingly, the foregoing description should not be read as pertaining only to the precise structures and techniques described, but rather should be read consistent with, and as support for, the following claims, which are to have their fullest fair scope.

What is claimed is:

1. In a fluid flood process for enhancing the secondary recovery of hydrocarbons from a reservoir involving at least one pair of respective fluid injection and hydrocarbon recovery wells, having well bores, including the steps of (i) establishing a horizontal injection fracture for each injection well, said injection fracture extending substantially horizontally from said injection well bore proximate a lower portion of said reservoir and; (ii) establishing a horizontal recovery fracture for each recovery well, said recovery fracture extending substantially horizontally from said recovery well bore and the recovery fracture being vertically displaced from and above said injection fracture in the hydrocarbon reservoir, the improvement comprising the steps of:

determining the azimuth of a vertical component of a fracture for said reservoir structure during the formulation of at least one of said fractures;

disposing said injection wells and said recovery wells along lines substantially parallel to said azimuth of said vertical component;

sizing the horizontal extent of said respective injection and recovery fractures to maximize overlap in the reservoir therebetween; and offsetting such injection and recovery wells to avoid a direct vertical path for the fluid flood between such respective injection and recovery fractures.

2. A process for enhancing the secondary recovery of hydrocarbons from a geological reservoir through at least one injection well bore and a plurality of production well bores which extend into the geological reservoir, the process comprising the steps of:

injecting a fracture fluid through the at least one injection well bore into a lower portion of the geological reservoir thereby forming a substantially horizontal injection fracture having an upward vertical component, the vertical component being elongated in an azimuth direction;

determining the azimuth of the elongation of the vertical component;

disposing the production well bores in a line substantially parallel with the azimuth of the elongation of the vertical component and displaced from said at least one injection well bore; and injecting a fracture fluid through said production well bores thereby forming, from each production well bore, a substantially horizontal production fracture, extending out into overlapping relation with and displaced above said injection fracture, without intersecting said vertical component, so as to permit a vertical sweep of hydrocarbons, using a fluid flood through the geological reservoir between overlapping portions of the at least one injection fracture and the production fractures.

3. The process of claim 2, where in the steps of injecting comprises the step of propping at least one of the fractures with about number 12/20 mesh sand.

4. The process of claim 2 comprising the step of selecting, for the reservoir, a reservoir that is less than about 1200 feet below the surface of the earth.

5. The process of claim 2 wherein the step of injecting to form the at least one injection fracture comprises the step of forming a substantially disk shaped fracture having a radius of about 265 to about 285 feet.

6. The process of claim 2 or claim 5 wherein the steps of injecting to form the, production fractures comprise the step of forming substantially disk shaped fractures having a radius of about 235 to 250 feet.

7. The process of claim 2 comprising the step of spacing the wells at about 2½ acre per well.

8. The process of claim 2 wherein the step of injection to form an injection fracture comprises the step of forming an injection fracture that has a larger horizontal area than each of the overlapping production fractures.

9. The process of claim 2 wherein the step of injecting to form the at least one injection fracture comprises the step of applying, in such at least one injection fracture, at least 60,000 to 70,000 gallons of fracture fluid to form a large horizontal fracture.

10. The process of claim 2 or 9 wherein the step of injecting to form the production fractures comprises the step of applying, in each of the production fractures, at least 35,000 to 38,000 gallons of fracture fluid to form a large horizontal fracture.

11. The process of claim 2 wherein the step of injecting to form the injection fractures comprises the step of forming the vertical component so that it extends vertically up to a horizontal plane intersecting the production an adjacent one of fractures.

12. The process of claim 2 wherein the step of injecting to form at least one injection well comprises the step of forming the horizontal injection fracture and vertical component having an opening between large opposite faces and wherein the size of the opening for the vertical component is less than the size of the opening for the horizontal injection fracture.

13. The process of claim 2 comprising the step of applying a vertical sweep of fluid through the injection well, the injection fracture and the reservoir to the production fracture and the production wells.

14. An enhanced secondary recovery of hydrocarbons system having a geological reservoir, at least one injection well bore and a plurality of production well bores which extend into the geological reservoir, comprising:

in a lower portion of the geological reservoir, a substantially horizontal injection fracture extending from and in communication with said at least one injection well bore, said injection fracture having an upward vertical component, the vertical component being elongated in an azimuth direction;

the production well bores each being positioned along a line substantially parallel with the azimuth of the elongation of the vertical component and displaced from said at least one injection well bore; and substantially horizontal production fractures, a different one of such production fractures in communication with and extending out from each of the production well bores into overlapping relation with and displaced above said injection fracture, without intersecting said vertical component, so as to permit a vertical sweep of hydrocarbons using a fluid flood, through the geological reservoir between overlapping portions of the at least one injection fracture and the production fractures.

15. The system of claim 14 wherein the fractures are propped with about number 12/20 mesh sand.

16. The system of claim 14 wherein the reservoir is less than about 1200 feet below the surface of the earth.

17. The system of claim 14 wherein the at least one injection fracture comprises a substantially disk shaped fracture having a radius of about 265 to about 285 feet.

18. The system of claim 14 or claim 17 wherein the production fractures each comprises a substantially disk shaped fracture having a radius of about 235 to 250 feet.

19. The system of claim 14 wherein the spacing of the wells is about 2½ acre per well.

20. The system of claim 15 wherein the injection fractures each have a larger horizontal area than each of the production fractures.

21. The system of claim 14 wherein the at least one injection fracture is large and, when formed, contained at least 60,000 to 70,000 gallons of fracture fluid.

22. The system of claim 14 or 21 wherein the production fractures are large and, before removal of pressure in the fracture fluid, contained at least 35,000 to 38,000 gallons of fracture fluid.

23. The system of claim 14 wherein vertical component extends up at least to a horizontal plane, intersecting the horizontal production fractures.

24. The system of claim 14 wherein each of the horizontal injection fractures and the vertical component have an opening between large opposite faces and wherein the size of the openings for the vertical component are less than the size of the opening for the horizontal injection fracture.

25. The system of claim 14 comprising a fluid passing through the injection well, the injection fracture and the reservoir to the production fractures and the well bores of the production wells.

26. The process of claim 1 comprising the step of propping at least some of the fractures with about number 12/20 mesh sand.

27. The process of claim 1 comprising the step of selecting, for the reservoir, a reservoir that is less than about 1200 feet below the surface of the earth.

28. The process of claim 1 comprising the step of forming, as each said injection fracture, a substantially disk shaped fracture having a radius of about 165 to about 285 feet.

29. The process of claim 1 or 28 comprising the step of forming, as each said recovery fracture, a substantially disk shaped fracture having a radius of about 235 to 250 feet.

30. The process of claim 1 comprising the step of spacing said wells at about 2½ acre per well.

31. The process of claim 1 comprising the step of forming said injection fracture with a larger horizontal area than the overlapping recovery fracture.

32. The process of claim 1 forming at least one said injection fracture while applying at least 60,000 to 70,000 gallons of fracture fluid to form a large horizontal fracture.

33. The process of claim 1 or 32 comprising the step of forming at least one said recovery fracture while applying at least 35,000 to 38,000 gallons of fracture fluid to form a large horizontal fracture.

34. The process of claim 1 comprising the step of forming at least one said injection fracture with said vertical component so that the vertical component extends vertically up to a horizontal plane intersecting an adjacent said production fracture.

35. The process of claim 1 comprising the step of forming at least one said horizontal injection fracture with a vertical component having an opening between large opposite faces and wherein the size of the opening for the vertical component is less than the size of the opening for the horizontal injection fracture.

36. The process of claim 1 comprising the step of applying a vertical sweep of fluid through each said injection well, the injection fractures thereof and the reservoir to the recovery fractures and the recovery well bores.

* * * * *

UNITED STATES PATENT AND TRADEMARK OFFICE

CERTIFICATE OF CORRECTION

PATENT NO. : 4,889,186

DATED : December 26, 1989

INVENTOR(S) : M.E. Hanson; L.D. Thorson

It is certified that error appears in the above-identified patent and that said Letters Patent is hereby corrected as shown below:

Column 1, line 64, change "super heated" to -- superheated --.
Column 1, line 67, change "water flood" to -- waterflood --.

Column 2, line 46, change "respectfully" to -- respectively --.

Column 4, lines 43,44, change "inches" to -- inch -- (both occurrences).

Column 5, line 1, change "proppend" to -- proppant --.
Column 5, line 6, delete "of".
Column 5, line 14, delete "is".
Column 5, line 26, change "respectfully" to -- respectively --.
Column 5, line 50, after "Institute" delete the period, insert a comma, and change "The" to -- the --.
Column 5, line 59, after "drilling" insert -- of --.

Column 6, line 68, change "water flooding" to -- waterflooding --.

Column 7, line 25, change "permissable" to -- permissible --.

Column 8, line 15, change "ad" to -- and --.

In the Claims

Column 9, line 41, change "where in" to -- wherein --.
Column 9, line 52, after "the" delete the comma.

UNITED STATES PATENT AND TRADEMARK OFFICE

CERTIFICATE OF CORRECTION

PATENT NO. : 4,889,186

DATED : December 26, 1989

INVENTOR(S) : M.E. Hanson; L.D. Thorson

It is certified that error appears in the above-identified patent and that said Letters Patent is hereby corrected as shown below:

Column 9, line 57, change "injection" to -- injecting --.

Column 10, line 7, before "fractures" insert -- production --.

Column 11, line 24, change "165" to -- 265 --.

Signed and Sealed this

Eighteenth Day of June, 1991

*Attest:*

*Attesting Officer*

HARRY F. MANBECK, JR.

*Commissioner of Patents and Trademarks*